United States Patent [19]

Eitel

[11] 4,044,902

[45] Aug. 30, 1977

[54] AERIAL LIFTING EQUIPMENT

[75] Inventor: Jay M. Eitel, Atherton, Calif.

[73] Assignee: General Cable Corporation, San Carlos, Calif.

[21] Appl. No.: 716,553

[22] Filed: Aug. 23, 1976

Related U.S. Application Data

[63] Continuation of Ser. No. 615,238, Sept. 22, 1975, abandoned.

[51] Int. Cl.[2] ..... E02F 3/70

[52] U.S. Cl. ..... 214/132; 182/2; 212/69

[58] Field of Search ..... 214/140, 132, 151; 182/2; 104/43, 45; 74/206; 212/66, 67, 68, 69

[56] References Cited

U.S. PATENT DOCUMENTS

| | | | |
|---|---|---|---|
| 3,369,672 | 2/1968 | Lorence | 212/69 |
| 3,437,175 | 4/1969 | Eitel | 182/2 |
| 3,537,550 | 11/1970 | Ely | 212/69 |
| 3,608,671 | 9/1971 | Ashworth | 182/2 |
| 3,664,515 | 5/1972 | Orendorff et al. | 212/69 |

*Primary Examiner*—Robert J. Spar
*Assistant Examiner*—Ross Weaver
*Attorney, Agent, or Firm*—Flehr, Hohbach, Test, Albritton & Herbert

[57] ABSTRACT

Aerial lifting equipment having a platform, a support structure and means rotatably mounting the support structure upon the platform for rotation about a substantially vertical axis. A boom structure is mounted on the support structure for movement about a substantially horizontal axis and drive means is mounted upon the platform and the support structure for causing rotation of the support structure about the vertical axis. The drive means includes a track structure mounted in a fixed position on the platform. The drive structure has a circular track surface and at least three spaced friction members adapted to engage the drive surface. Motive means is provided for driving at least one of the friction members. The motive drive means includes planetary gearing within one of the friction members. Preloading means is provided for applying preloading forces to the one friction drive member to yieldably urge it into engagement with the circular drive surface. Azimuth switch means is provided for preventing rotation of the support structure about the means rotatably mounting the same through more than a predetermined number of revolutions.

8 Claims, 9 Drawing Figures

FIG-7
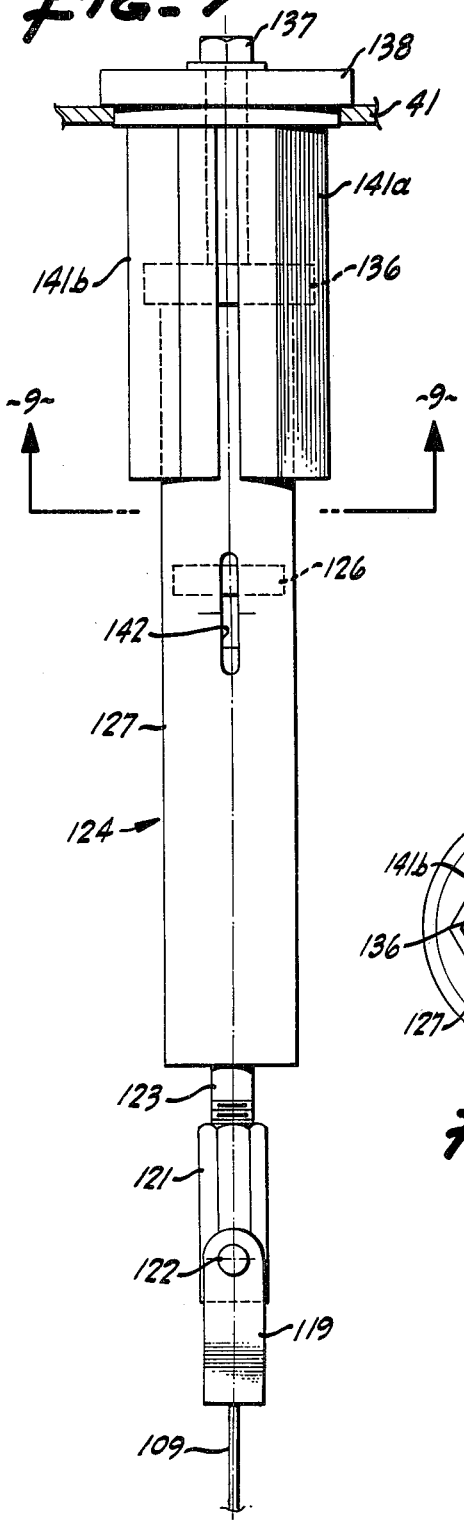
FIG-8
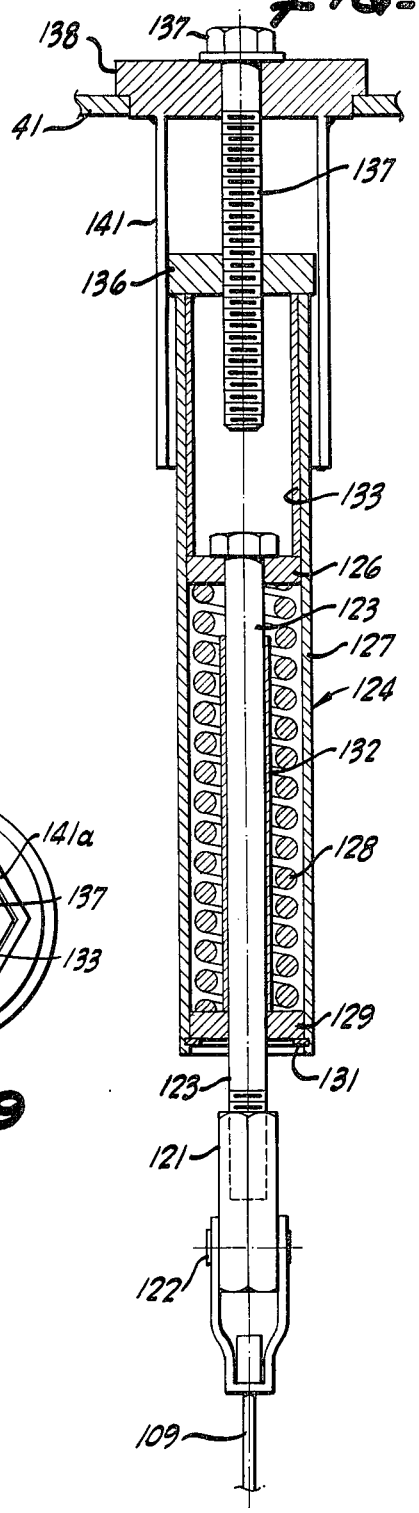
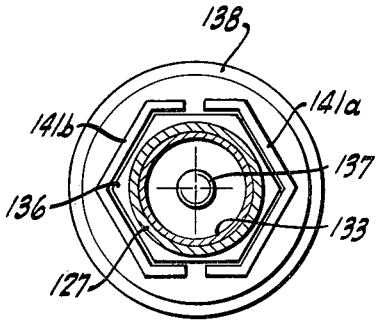
FIG-9

AERIAL LIFTING EQUIPMENT

This is a continuation of application Ser. No. 615,238 filed Sept. 22, 1975, now abandoned.

BACKGROUND OF THE INVENTION

In U.S. Pat. No. 3,437,175, there is disclosed a lifting equipment of the type of the present invention. However, such lifting equipment does not include certain specific features which it has been found that it is desirable to include in such lifting equipment as, for example, specific drive means, preloading means and means for preventing over-rotation of the aerial lifting equipment. There is, therefore, a need for a new and improved aerial lifting equipment.

SUMMARY OF THE INVENTION AND OBJECTS

The aerial lifting equipment comprises a platform, a support structure and means rotatably mounting the support structure upon the platform about a substantially vertical axis. A boom structure is mounted on the support structure for movement about a substantially horizontal axis and drive means mounted upon the platform and the support structure for causing rotation of the support structure about the substantially vertical axis. The drive means includes a track structure mounted in a fixed position on the platform with the drive structure having a circular track surface. At least three spaced friction members adapted to engage the drive surface are provided. Motive means is provided for driving at least one of the friction members. The motive means includes a motor having an output shaft and speed reducing gearing connecting the output shaft of the motor to the one friction member. The one friction member is in the form of a wheel assembly. The speed reducing gearing includes a gear assembly which is mounted within the confines of the wheel assembly. Means is provided for applying a preload force to the one friction member for yieldably urging the friction member into engagement with the drive surface. Means is also provided for preventing operation of the motive means when the support structure has been rotated through more than a predetermined number of revolutions with respect to the means rotatably supporting the same.

In general, it is an object of the present invention to provide an aerial lifting equipment which is capable of sustaining heavy side loading.

Another object of the invention is to provide equipment of the above character in which the side load assuming capabilities can be adjusted.

Another object of the invention is to provide lifting equipment of the above character in which the maximum rotational forces can be readily adjusted by use of a load cell.

Another object of the invention is to provide lifting equipment of the above character which prevents operation of the lifting equipment when it has been rotated through more than a predetermined number of revolutions.

Another object of the invention is to provide lifting equipment of the above character in which the condition of the load cell can be readily ascertained.

Another object of the invention is to provide lifting equipment of the above character in which the motive drive means is relatively compact.

Additional objects and features of the invention will appear from the following description in which the preferred embodiments are set forth in detail in conjunction with the accompanying drawings.

Another object of the invention is to provide lifting equipment of the above character which will automatically limit the load when encountering the obstruction or when an excessive side force is imposed on the boom.

BRIEF DESCRIPTION OF THE DRAWINGS

FIG. 7 is an enlarged view of the load cell.

FIG. 8 is a cross-sectional view of the load cell shown in FIG. 7.

FIG. 9 is a cross-sectional view taken along the line 9—9 of FIG. 7.

DESCRIPTION OF THE PREFERRED EMBODIMENT

Figure 1:
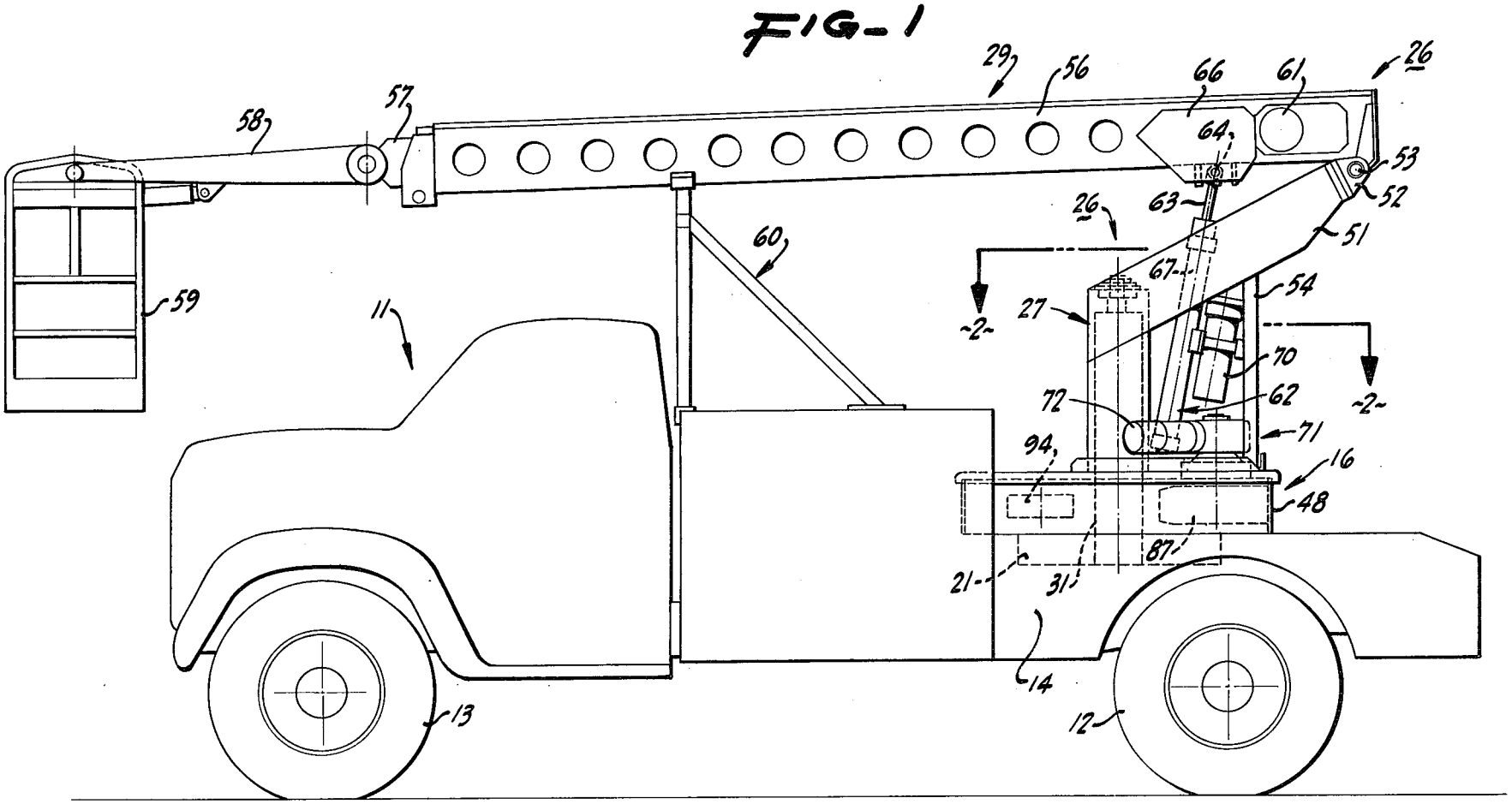
FIG. 1 is a side elevational view of an aerial lifting equipment incorporating the present invention.

The aerial lift as shown in the drawings consists of a self-propelled vehicle 11 having front and rear wheels 12 and 13 mounted upon a chassis or framework 14. The self-propelled vehicle 11 is provided with suitable motive means (not shown) for supplying power to the wheels of the vehicle. A platform or base 16 is provided which is mounted upon the framework. This platform 16 can be of any suitable type which provides sufficient structural rigidity and which is connected into a framework 14 in the proper manner. As shown in the drawing, such a platform 16 can consist of box members 17 mounted on top of the framework 14 and secured thereto by suitable means such as plates 18 which are welded to the box-like frame members 17 and are secured to the framework 14 by bolts 19. A box-like base 21 is secured by bolts 22 on the four corners of the box-like base to brackets 23 which are secured to suitable means such as welding to the box-like frame members 17. The box-like base 21 is designed in such a manner so that it can absorb azimuth torque which is generated by the lifting equipment as hereinafter described. The box-like base 21 is provided with diagonal reinforcing members 24.

A lifting equipment 26 is mounted upon the platform 16. It consists of a support structure 27 and means 28 which is provided for rotatably mounting the support structure upon the platform. A boom structure 29 is mounted upon the support structure 27 for movement about a substantially horizontal axis as hereinafter described.

The means 28 for rotatably mounting the support structure 27 consists of a mast 31 which is centrally disposed within the box-like base 21 and is mounted on the base by welding it to reinforcing plates 32 which are welded to a bottom plate 33 forming a part of the box-like base 21 and to a top plate 34 also forming a part of the base 21. A stub shaft 36 is mounted on the top end of the vertically extending mast 31. A spherical bearing assembly 37 is mounted on the stub shaft 36.

Figure 2:
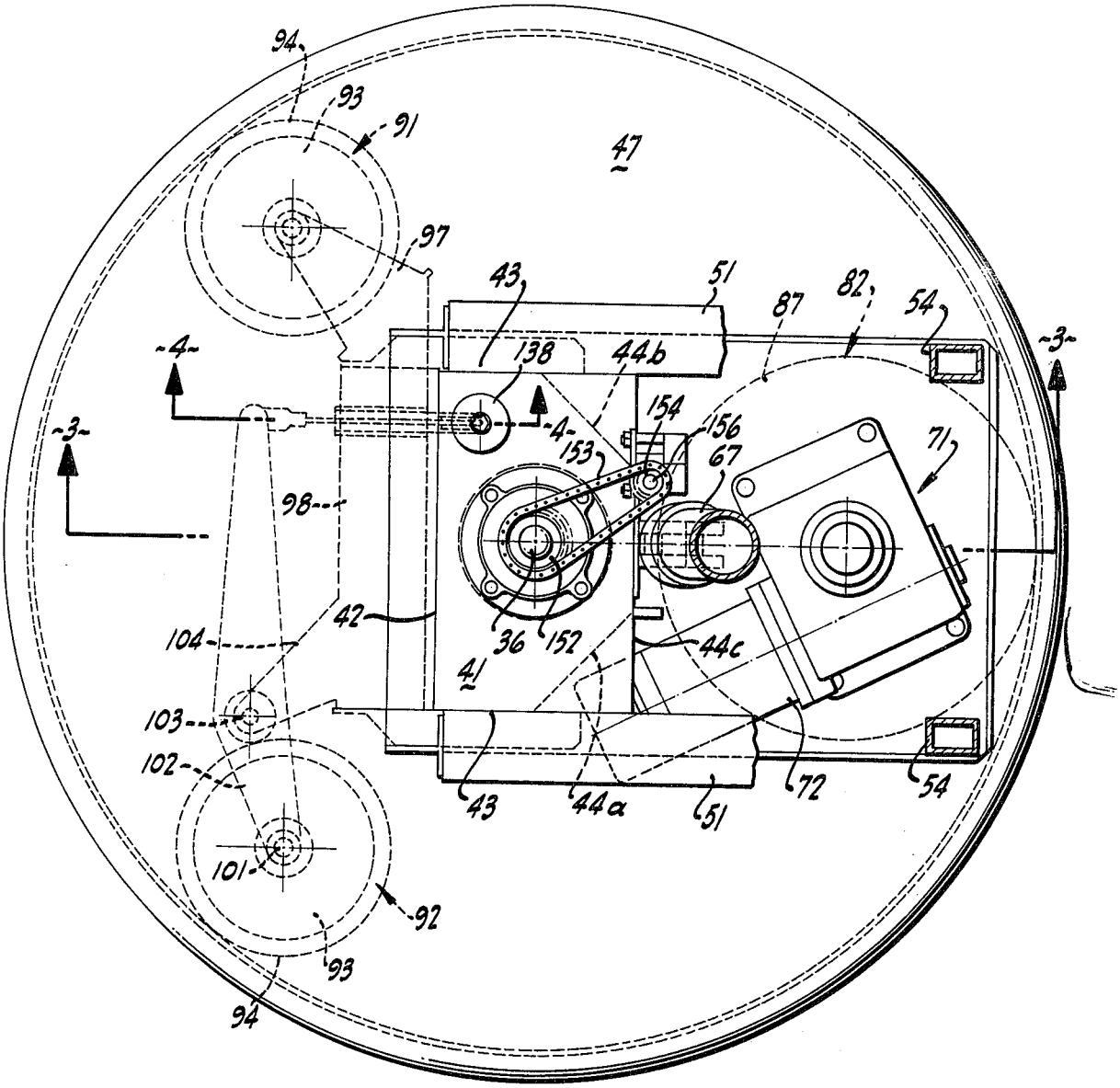
FIG. 2 is a cross-sectional view taken along the line 2—2 of FIG. 1.

The support structure 27 consists of a top plate 39 which is secured to the spherical bearing assembly 37 and is mounted on the upper end of a large hollow member 41 which is rotatably mounted upon the mast 31 and extends downwardly along the mast for a substantial distance. The member 41 is generally rectangular in cross-section in plan and with the exception of one side wall which is vee-shaped in cross-section. It can be seen from FIG. 2 that the member 41 is provided with a generally vertical planar front wall 42, spaced parallel vertical side walls 43 which extend at right angles to the wall 42 and vertical rear wall portions 44*a* and 44*b* which extend at obtuse angles to the side walls 43 and a vertical rear wall portion 44*c* which is parallel to the front wall 42 (see FIG. 2). The lower extremity of the member 41 is secured to a large plate 46 by suitable means such as welding. The plate 46 has mounted thereon a large circular plate 47 which lies generally in a horizontal plane and extends over the top of a tub or circular track structure 48 which is mounted on the plane 34. The plate 47 overlies and covers the tub 48 which is open through its top end. The plate 47 is provided with a downwardly extending lip portion 47*a* (see FIG. 3).

The support structure 27 consists of a pair of arms 51 which are secured to opposite sides of the member 41 by suitable means such as welding. As can be seen from FIGS. 1 and 3, the arms 51 are inclined upwardly and have a fitting 52 secured to the outer ends of the same which carries a pivot pin 53 upon which the boom structure 29 is pivotally mounted for movement about a horizontal axis formed by the pivot pin 53. A pair of spaced vertical support posts 54 are mounted on the plate 46 and are secured to the arms 51 near the outer ends thereof to support the same.

The boom structure 29 is of a type described in U.S. Pat. No. 3,437,175 and is comprised of a main or outer section 56 and a telescoping inner section 57. A forked structure 58 is mounted on the outer end of the inner section 57 and has pivotally mounted thereon a workman's platform or basket 59. A boom rest 60 is mounted on the vehicle 11 and is adapted to carry the boom structure 29 as shown in FIG. 1 of the drawings so that it is in a substantially horizontal position with the boom structure 29 extending forwardly over the cab of the vehicle.

Means is provided in the form of a motor brake assembly 61 mounted on the outer section of the boom 56 for extending and retracting the inner section 57 with respect to the outer section 56. Means is provided for raising and lowering the outer end of the boom structure about the horizontal pivot axis 53 and comprises a hydraulic actuator 62 having a piston rod 63 pivotally connected by a pin 64 to the outer boom section 56. The pin 64 is mounted between a pair of plates 66 carried by the outer boom section 56. The cylinder 67 of the hydraulic actuator 62 is pivotally connected by a pin 68 mounted between a pair of lugs 69 welded to the plate 46 adjacent the base of the member 41. A motor-driven hydraulic pump 70 (see FIG. 1) is provided for supplying hydraulic fluid to the hydraulic actuator 62.

Means is provided for causing relative rotational movement between the support structure 27 and the means 28 for rotatably mounting the support structure and comprises motor drive means 71 in the form of a gear motor 72. The gear motor 72 includes a three-phase electric motor of a suitable size such as 1 HP which has an output shaft (not shown) having a worm (not shown) mounted thereon driving a worm gear (not shown) to provide a suitable speed reduction ration such as 40:1. The gear motor 72 is secured by bolts 73 to a mounting place 74 which is secured to the plate 46 by suitable means such as welding.

Figures 3, 4:
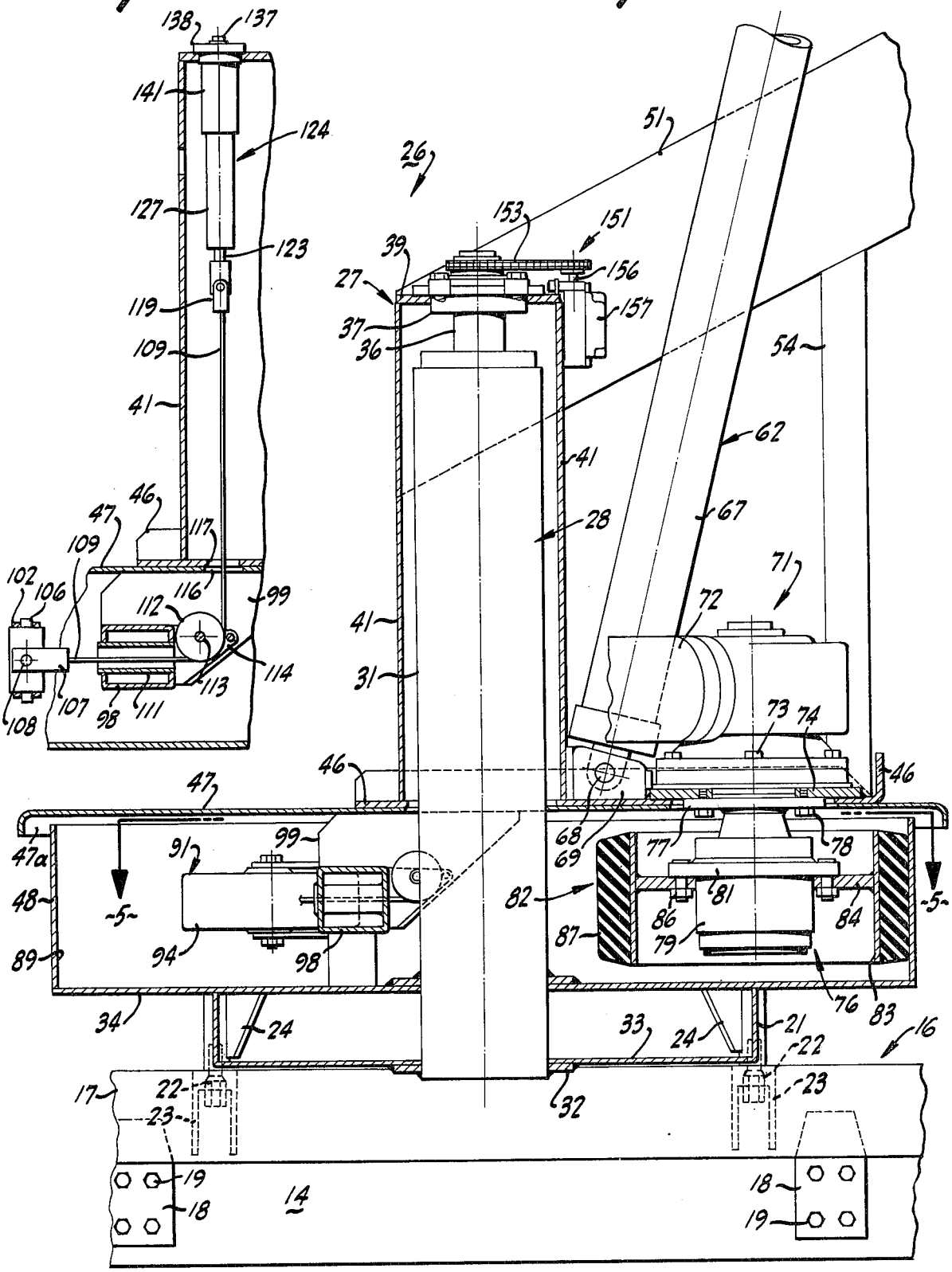
FIG. 3 is a cross-sectional view taken along the line 3—3 of FIG. 2.
FIG. 4 is a cross-sectional view taken along the line 4—4 of FIG. 2.
Figure 5:
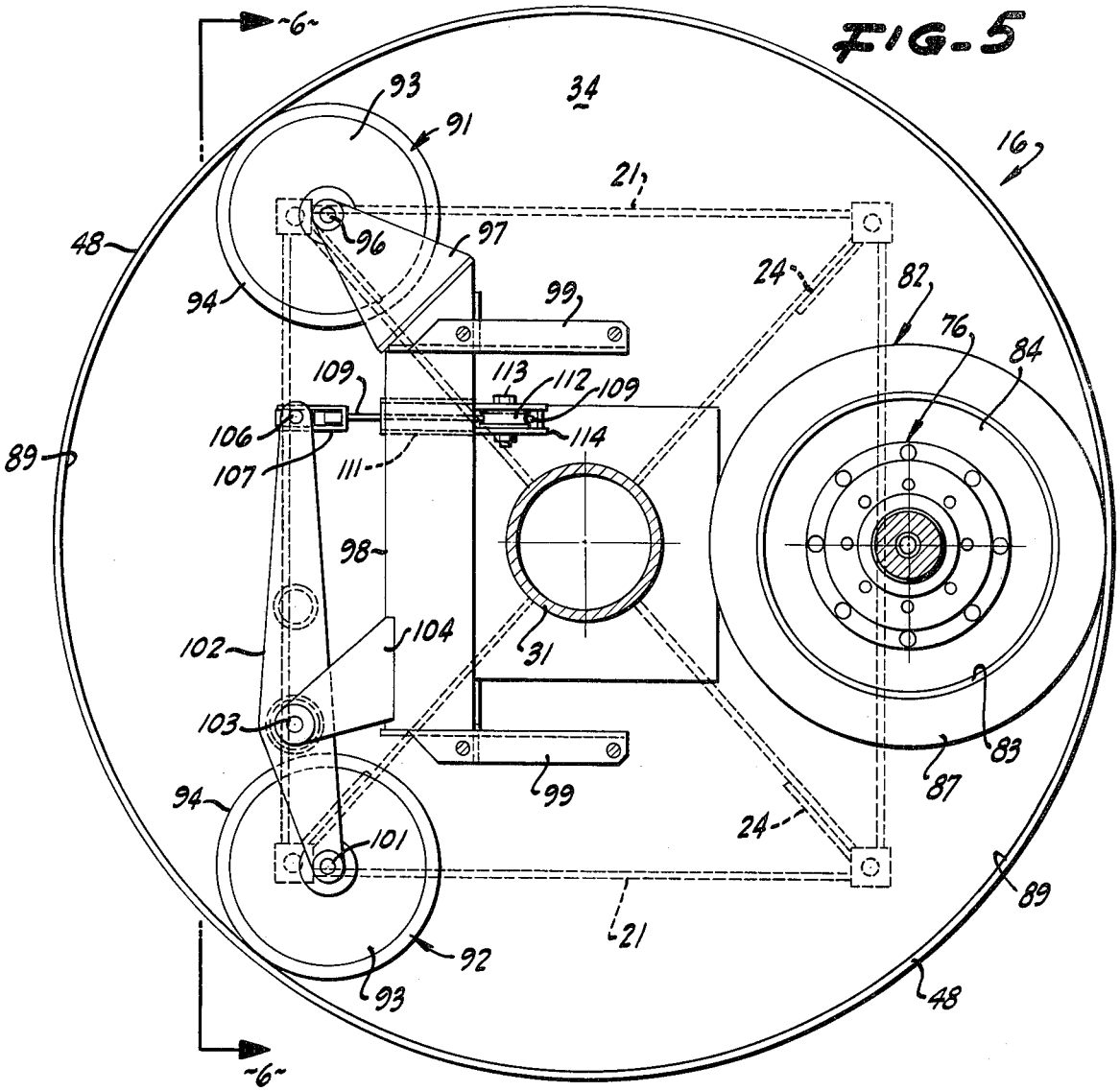
FIG. 5 is a cross-sectional view taken along the line 5—5 of FIG. 3.
Figure 6:
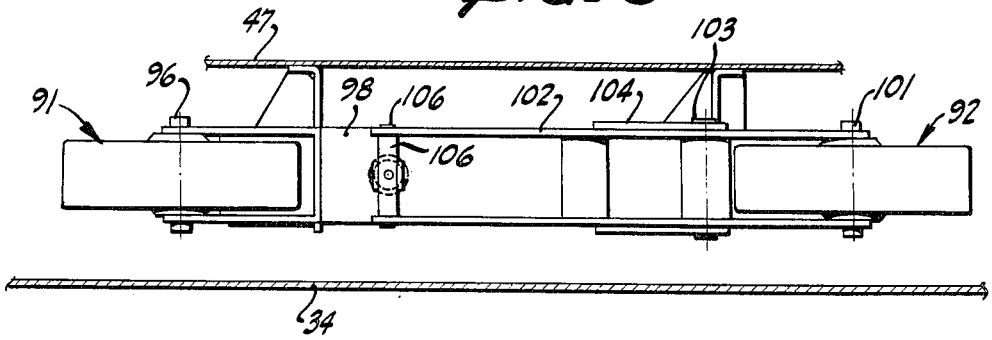
FIG. 6 is a cross-sectional view taken along the line 6—6 of FIG. 5.

The gear motor 72 drives a double planetary gear assembly 76 of a conventional type. The gear assembly 76 is provided with a flange 77 which is secured to the mounting plate by bolts 78. The double planetary gear assembly provides another suitable reduction as, for example, 30.89:1 reduction. The outer housing 79 of the double planetary gear assembly is rotated by the gear motor 72 and carried a radially extending flange 81. A drive wheel or friction assembly 82 (see FIG. 2) is mounted on the flange 81 and includes a rim 83 formed of suitable material such as steel and which carries an annular web 84 which is secured to the flange 81 by bolts 86. A solid rubber tire 87 is mounted on the rim 83 and is of a suitable size and hardness. The drive wheel assembly 82 is positioned in such a manner that the tire 87 is adapted to engage the inner vertical surface 89 of the tub or circular track structure 48 as can be seen in FIG. 3.

Means is provided for applying a preload to the drive wheel assembly 82 so that it is maintained in engagement with the annular surface 89 of the tub or circular track structure 48 and consists of two additional wheel or friction assemblies 91 and 92 which are offset approximately 120° with respect to each other and 120° with respect to the drive wheel assembly 82. Each of the wheel assemblies 91 and 92 includes a wheel 93 formed of a suitable material such as aluminum which carries a solid polyurethane tire 94 which is adapted to engage the annular surface 89 of the tub or circular track structure 48. The wheel assembly 91 is rotatably mounted on a pin 96 carried by a bracket 97 mounted on a box-lke member 98 that is welded to a pair of gussets 99 secured to the plates 46 and 47. The other wheel assembly 92 is rotatably mounted upon a pin 101 carried on one end of an arm 102. The arm 102 is pivotally mounted by a pin 103 in a bracket 104 secured to the other end of the box-like member 98. A pivot pin 106 is carried by the other end of the arm 102. A connecting link 107 is pivotally mounted on the pin 102 by a pin 108. A flexible steel cable 109 has one end secured to the bracket 107 and extends through a tube 111 provided in the box-like member 98 and then passes over a pulley 112 rotatably mounted on a pin 113 carried by a bracket 114 secured to the box-like member 98. The cable 109 extends upwardly through holes 116 and 117 provided in the plates 47 and 46, respectively.

The cable 109 is secured to a U-shaped connecting link 119 which is pivotally connected to a nut 121 by a pin 122. The nut 121 is threaded onto a long screw 123 forming a part of a load cell assembly 124. The head of the screw engages a washer 126 which is slidably mounted within an elongate cylindrical tube 127. The washer 126 engages one end of a compression spring 128 disposed within the tube. The other end of the spring engages a washer 129 which is retained within the tube by a retaining ring 131. A sleeve 132 is coaxially mounted upon the screw 123 within the spring 128 which serves to limit the amount of compression which can be applied to the spring 128 because it limits the downward movement of the washer 126. Another sleeve 133 is mounted within the tube 127 above the washer 126 and serves as a limit or stop in the opposite direction for the washer 126. A cap 136 is secure to the upper end of the tube 127 by suitable means such as welding. A cap screw 137 is threaded into the cap 136 and is rotatably mounted in another cap 138 which is mounted in the upper portion of the column or member 41. The sleeve 141 is formed in two sections 141*a* and 141*b*. As can been seen in FIGS. 7, 8 and 9, the sleeve 141 is generally hexagonal and engages the hexagonal cap 136 to prevent rotation of the tube 127 relative to the cap 138. A slot 142 extending longitudinally of the sleeve 127 is provided in the sleeve to permit viewing of the position of the washer 126 and to thereby ascertain the condition of the load cell as to whether it is lightly or heavily loaded.

An azimuth switch assembly 151 is provided to prevent twisting or turning off of the cables or hoses utilized in conjunction with the lifting equipment and which extend from the support structure 27 into the boom structure 29. As shown in the drawings, such as azimuth switch assembly 151 consists of a gear 152 which is mounted on the upper end of the mast 36. The gear drives a chain 153 which drives another gear 154. The gear 154 is mounted on a shaft 156 which is part of a rotary switch 157 mounted on the member 41. The switch 157 is timed in such a manner that upon relative motion between the support structure 27 and the means for rotatably mounting the support structure beyond a predetermined number of revolutions, a limit switch will be operated to remove the power from the azimuth drive gear motor 72. This prevents rotation of the support structure about the mast 36 in the same direction which could cause twisting and tearing off of the cables due to excessive twisting. The support structure thereafter must be rotated in the opposite direction to unwind the cables to permit continued operation of the lifting equipment.

Control means (not shown) is provided of the type described in U.S. Pat. No. 3,437,175 for controlling the operation of the boom structure either from the workman's platform or basket 59 or from the vehicle itself.

Operation and use of the aerial lift may now be briefly described as follows. Let it be assumed the serial lift is in the position shown in FIG. 1 with the boom structure 29 in a stored position. The vehicle is driven to the desired location and then by the use of the ground controls (not shown), the boom structure 29 has its outer end elevated by operation of the hydraulic actuator 62 by pivoting the boom structure 29 about the horizontal axis 53. The boom structure 29 is then rotated about a vertical axis formed by the mast 31 by operation of the aximuth motor drive means 71 so that the boom structure clears the vehicle. The outer end of the boom structure can then be lowered by operation of the hydraulic actuator 62 through operation of the motor driven hydraulic pump 70. As soon as the basket 49 has been lowered to the ground, the workmen can step into the basket and can assume control of the operation of the aerial lift by operating the control means (not shown) within the basket to cause movement of himself and the workman's basket 59 to the desired location. Thus, controls are provided for rotating the basket about a vertical axis formed by the mast 31, raising and lowering the same about a horizontal axis 53 and for extending and retracting the inner boom section 57 with respect to the outer boom section 56 to thereby move the basket 59 and the workman carried thereby to the desired location. After the work has been completed, the workman can again control the operation of the boom structure to bring the basket back down to the ground, after which the workman can step out of the basket and operate the boom structure by the ground control to return it to its home or stowed-away position as shown in FIG. 1.

The operation of the azimuth drive means or, in other words, the means for causing rotational movement of the support structure about the mast 31, includes the spherical bearing assembly 37 which permits some rocking motion of the support structure relative to the mast. This is important because it permits the weight of the boom and the payload carried by the boom structure to be added to the loading which is applied to the drive wheel assembly 82 to cause the same to more firmly frictionally engage the surface 89.

In addition, as hereinbefore described, the desired amount of preloading is provided on the drive wheel assembly 82 and the two wheel assemblies 91 and 92. Preloading of the wheel assembly 92 is by use of the load cell. By adjustment of the screw 137, the pretensioning force applied by the load cell 124 can be adjusted. As soon as additional force is applied to the wheel assembly 92, similar resulting forces are applied to the wheel assembly 93 and to the drive wheel assembly 82. This is true because with the three-cornered arrangement of the wheel assembly as soon as a force is applied to one of the wheel assemblies, there is a counterbalancing reaction on the other two wheel assemblies.

It has been found that the present azimuth rotational drive assembly provided with the aerial lift has significant side loading capabilities in excess of that previously available with other types of similar equipment. By way of example, approximately three times greater side loading can be obtained on the present aerial lift in comparison to the side loading on certain prior art aerial lifts. In connection with such increased side loading capability, the azimuth drive means has an automatic clutching mechanism which is inherent in the rubber tired drive which is utilized. Thus, if there is sideways overloading of the boom structure, the rubber tire will slip on the drive surface 89 and thereby prevent damage to the aerial lift.

In connection with the present design, the overhang of the aerial lift from the vehicle is substantially reduced. For example, there is no overhang beyond 48 inches in any mode or position of the boom structure relative to the vehicle. This is advantageous because it places more of the load over the rear axle of the vehicle. The azimuth limit switch assembly prevents undue twisting and tearing up of any cables which may be utilized in conjunction with the aerial lift.

It is apparent from the foregoing that there has been provided a new and improved aerial lift which is particularly adaptable for assuming greater side loads such as in cable stringing operations. Preloading means is provided to ensure that there is sufficient frictional engagement between the drive wheel assembly and the circular track structure. In addition, the aerial lift is constructed in such a manner so that any loading which is carried by the boom structure supplements the forces establishing frictional engagement between the drive wheel assembly and the circular track structure. There is also reduced overhang from the boom structure thereby increasing the load carrying capabilities of the vehicle.

I claim:

1. In a lifting equipment, a platform, a support structure, means rotatably mounting the support structure upon the platform for rotation about a substantially vertical axis, a boom structure mounted on the support structure for movement about a substantially horizontal axis and drive means mounted upon said platform and said support structure for causing rotation of said support structure about said substantially vertical axis, said drive means including a track structure mounted in a fixed position on the platform, said drive structure having a circular track surface, at least three spaced friction members offset from the vertical axis and adapted to engage the circular track surface, motive means for driving only one of said three friction members, said motive means including a motor having an output shaft and speed reducing gearing connecting the output shaft of the motor to said one friction member, said one friction member being in the form of a wheel assembly having an outer tire, said speed reducing gearing including a gear assembly mounted within the confines of the wheel assembly and means for applying a preload force to said one friction member to yieldably urge said outer tire into engagement with said circular track surface, said means for applying a preload force including means for applying a yieldable force to at least one of said three friction members other than said one friction member to yieldably urge said at least one friction member into engagement with said circular track surface whereby a preload force is applied to said one friction member which is sufficient to permit said boom structure to sustain heavy side loading.

2. A lifting equipment as in claim 1 wherein said gear assembly mounted within the confines of the wheel assembly is in the form of a planetary gear assembly.

3. A lifting equipment as in claim 1 together with a wheeled vehicle and means mounting said platform on said wheeled vehicle.

4. A lifting equipment as in claim 1 together with automatically operated azimuth switch means operable solely by rotation of said support structure in one direction a predetermined number of revolutions in excess of one in said one direction for preventing further operation of said motive means in one direction when said support structure has been rotated through more than a predetermined number of revolutions in excess of one in said one direction with respect to said means rotatably mounting the support structure upon the platform.

5. In a lifting equipment, a platform, a support structure, means rotatably mounting the support structure upon the platform for rotation about a substantially vertical axis, a boom structure mounted on the support structure for movement about a substantially horizontal axis and drive means mounted upon said platform and said support structure for causing rotation of said support structure about said substantially vertical axis, said drive means including a track structure mounted in a fixed position on the platform, said drive structure having a circular track surface, at least three spaced friction members adapted to engage the drive surface, motive means for driving at least one of said three friction members, said motive means including a motor having an output shaft and speed reducing gearing connecting the output shaft of the motor to said one friction member, said one friction member being in the form of a wheel assembly, said speed reducing gearing including a gear assembly mounted within the confines of the wheel assembly and azimuth switch means for preventing further rotation of said motive means in one direction when said support structure has been rotated for more than a predetermined number of revolutions in said one direction with respect to said means rotatably mounting the support structure upon the platform, said azimuth switch means including a rotary switch mounted on said support structure and drive means connected between said switch and said means rotatably mounting the support structure for causing operation of the switch.

6. In a lifting equipment, a platform, a support structure, means rotatably mounting the support structure upon the platform for rotation about a substantially vertical axis, a boom structure mounted on the support structure for movement about a substantially horizontal axis and drive means mounted upon said platform and said support structure for causing rotation of said support structure about said substantially vertical axis, said drive means including a track structure mounted in a fixed position on the platform, said drive structure having a circular track surface, at least three spaced friction members adapted to engage the drive surface, motive means for driving at least one of the friction members for applying a preload force to said one friction drive member to yieldably urge said one friction drive member in a direction so that it is moved into engagement with said circular track surface, said preloading means including an arm pivotally mounted on said support structure, another of said friction members being mounted on said arm on one side of the pivot point of said arm and adjustable yieldable spring means secured to said arm on the other side of said pivot point for applying a force to said arm to move said another friction member into engagement with said circular drive surface, said adjustable yieldable spring means including a load cell, said load cell comprising a tubular member, spring means disposed within the tubular member, means mounted in the tubular member engaging one end of the spring means for retaining the spring means within the tubular member, an elongate element extending through the spring means and engaging the other end of the spring means, means engaging the other end of the spring means including means for securing said elongate element of said load cell to said arm and means disposed within the tubular member for limiting the movement of said elongate element in the tubular member.

7. In a lifting equipment, a platform, a support structure, means rotatably mounting the support structure upon the platform for rotation about a substantially vertical axis, a boom structure mounted on the support structure for movement about a substantially horizontal axis and drive means mounted upon said platform and said support structure for causing rotation of said support structure about said substantially vertical axis, said drive means including a track structure mounted in a fixed position on the platform, said drive structure having a circular track surface, at least three spaced friction members adapted to engage the drive surface, motive means for driving at least one of the friction members and means for applying a preload force to said one friction drive member to yieldably urge said one friction member in a direction so that it is moved into engagement with said circular track surface, said preloading means including an arm pivotally mounted on said support structure, another of said friction members being mounted on said arm on one side of the pivot point of said arm and adjustable yieldable spring means secured to said arm on the other side of said pivot point for applying a force to said arm to move said another friction member into engagement with said circular drive surface, said adjustable yieldable spring means including a load cell, said load cell comprising a tubular member, spring means disposed within the tubular member, means mounted in the tubular member engaging one end of the spring means for retaining the spring means within the tubular member, an elongate element extending through the spring means and engaging the other end of the spring means and means engaging the other end of the tubular member for adjusting the position of the tubular member, said spring means including means for securing said elongate element of said load cell to said arm, said load cell including slot means disposed in the tubular member to permit viewing of the position of the elongate element to thereby make it possible to ascertain the amount of preloading being applied by the load cell.

8. In a lifting equipment, a platform, a support structure, means rotatably mounting the support structure upon the platform for rotation about a substantially vertical axis, a boom structure mounted on the support structure for movement about a substantially horizontal axis and drive means mounted upon said platform and said support structure for causing rotation of said support structure about said substantially vertical axis, said drive means including a track structure mounted in a fixed position on the platform, said drive structure having a circular track surface, at least three spaced friction members adapted to engage the drive surface, motive means for driving at least one of the friction members, and means for applying a preload force to said one friction member to yieldably urge one friction drive member in a direction so that it is moved into engagement with said circular track surface, said preloading means including an arm pivotally mounted on said arm on one side of the pivot point of said arm and adjustable yieldable spring means secured to said arm on the other side of said pivot point for applying a force to said arm to move said another friction member into engagement with said circular drive surface, said adjustable yieldable spring means including a load cell, said load cell comprising a tubular member, spring means disposed within the tubular member, means mounted in the tubular member engaging one end of the spring means for retaining the spring means within the tubular members, an elongate element extending through the spring means and engaging the other end of the spring means, and means engaging the other end of the tubular member for adjusting the position of the tubular member, said adjustable spring means including means for securing said elongate element of said load cell to said arm.

* * * * *